United States Patent [19]

Chein

[11] Patent Number: 4,821,434

[45] Date of Patent: Apr. 18, 1989

[54] SHOE STRUCTURE WITH NAILS TO EXTEND OUT OR RETRACT IN BY KICKING FORWARDS OR BACKWARDS

[76] Inventor: Chung-Min Chein, No. 69, Kou Jung Rd., I-Lan City, Taiwan

[21] Appl. No.: 157,886

[22] Filed: Feb. 19, 1988

[51] Int. Cl.[4] ..... A43C 15/02; A43C 15/00

[52] U.S. Cl. ..... 36/134; 36/61

[58] Field of Search ..... 36/61, 134, 114, 127, 36/62, 59 R

[56] References Cited

U.S. PATENT DOCUMENTS

| | | | |
|---|---|---|---|
| 3,717,238 | 2/1973 | Fox | 36/61 |
| 3,793,751 | 2/1974 | Gordos | 36/61 |
| 3,983,643 | 10/1976 | Schreyer et al. | 36/61 |
| 4,226,032 | 10/1980 | Herro | 36/61 |
| 4,333,249 | 6/1982 | Schaefer | 36/61 |
| 4,375,729 | 3/1983 | Buchanen, III | 36/61 |

FOREIGN PATENT DOCUMENTS

| | | | |
|---|---|---|---|
| 1965198 | 8/1971 | Fed. Rep. of Germany | 36/61 |

*Primary Examiner*—Steven N. Meyers

*Attorney, Agent, or Firm*—Asian Pacific International Patent & Trademark Office; Patent & Trademark Office

[57] ABSTRACT

The shoe has spikes which can be extended and retracted by T-shaped rail members which are actuated by respectively impacting the front or the rear of the shoe sole against a solid target such as a wall or road surface.

9 Claims, 4 Drawing Sheets

SHOE STRUCTURE WITH NAILS TO EXTEND OUT OR RETRACT IN BY KICKING FORWARDS OR BACKWARDS

BACKGROUND OF THE INVENTION

The adaptability of conventional shoes is limited; for instance, the conventional mountaineer shoes or the working shoes may, no matter what patterns are being furnished under the sole, cause slipping and hazards upon walking on a road which is covered with slippery substances such as greenmoss, ice, snow, mud, or powder. Also, walking on a difficult terrain such as a slope, a narrow single-lumber bridge, a greasy road, ground covered with wet grass, in deep forests, on a rolling stone, a rocky area, or a slippery road under bad weather condition, etc., is hazardous at times.

Normally, the conventional nail shoes are not fully adequate in allowing a person to walk on a road, such as a road paved with asphalt, cement, terra cotta, tiles, plastic tiles, wood or stone, etc.; and conventional nail shoes not only are inadequate for walking on the aforesaid road surfaces, but also may damage the road surface and the nails of such shoes, and may cause the wearer to fall.

Moreover, the inventor believes that the shoes according to the present invention have not been shown in any publication; in other words, there are no shoes so far, which can equally be used on a ground surface or in the field, or at a working site to protect a worker's safety and to increase the working efficiency.

SUMMARY OF THE INVENTION

In view of the aforesaid drawbacks of the conventional shoes, the inventor has, developed the present invention.

The major feature of the present invention resides in the sandwiched members and the sole structure, which are simple, light, and sealed in the sole. In operation, the wearer just kicks the shoes forwards onto a hard object (such as a stone, a wall foot, or a tree stem) to have all the nails extended from the sole so as to facilitate to walk on a slippery ground or a rocking surface (such as on the deck of a ship or in a car) stably and swiftly. Upon walking on a normal ground, the wearer may just kick the shoes backwards against a hard object to have all the extended nails retracted into the sole. In that case, the soles of the shoes according to the present invention will have adequate elasticity for walking with comfort and convenience.

Another feature of the present invention is that the special design of the sole and the sandwiched members can prevent the wearer's feet from being injured by unexpected kicking, impact, hitting, stinging, scratching or cutting. With the shoes according to the present invention, a person can walk on surfaces such as the field, a hazardous road, a slippery slope, or can push or pull something on a slope, or can climb a cliff or a tree, or can walk across a mountain area, a slippery ground covered with greenmoss, or a lumber bridge, or cement ground, or a road covered with wastes.

A further feature of the present invention is that the wearer of the present invention may, at the beginning, feel the shoes being rather heavy, somewhat like to wearing boots or mountaineer shoes or rain shoes; however, that feeling will disappear after wearing a given period of time (i.e., the natural resistant effect as mentioned in medical field), and the wearer will become used to it. The aforesaid condition may compare to the condition of a person who, for the first time, wears a bigger watch or earrings, or a thicker eyeglass frame. Upon a wearer changing from the present invention to a normal pair of shoes, he (or she) may feel to gain much more vigorous force or energy than ever before, becoming rather active; therefore, the present invention is deemed to concern a novel and practical shoe, and which may be referred to as a "Kungfu" shoes.

DETAILED DESCRPTION

Figure 1:
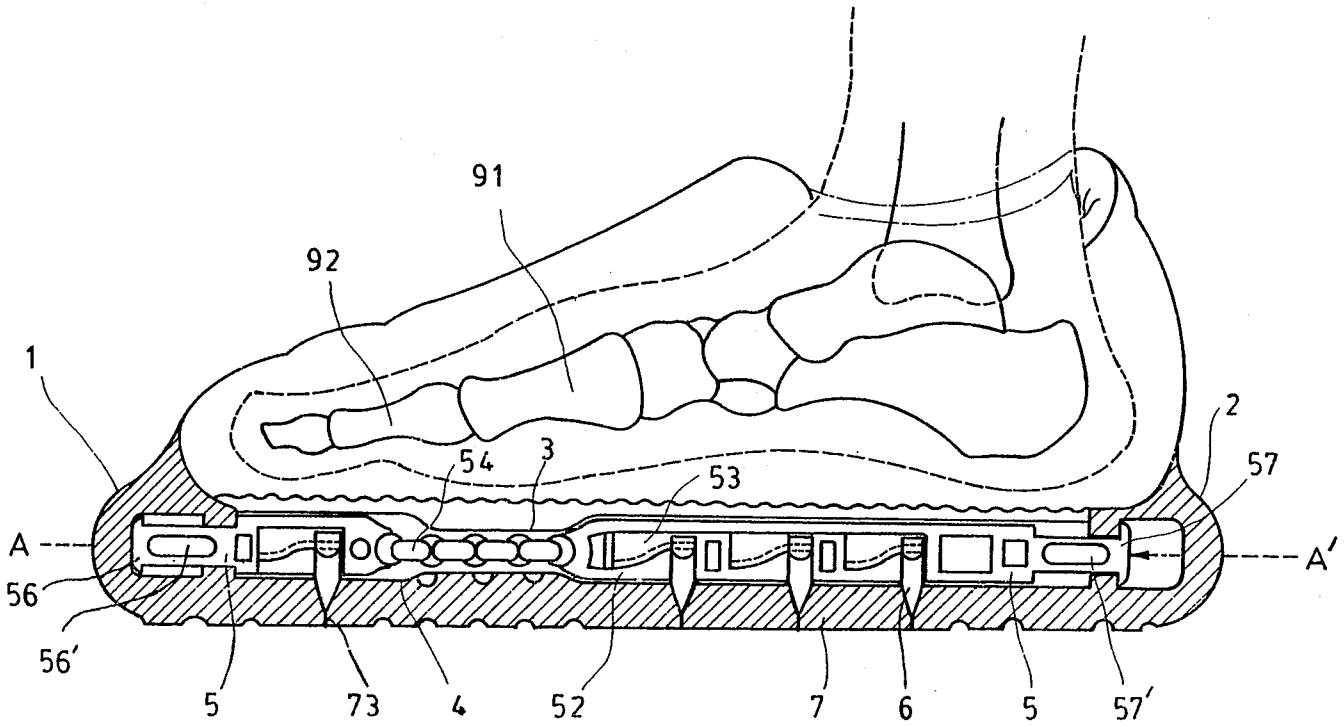
FIG. 1 illustrates a longitudinal sectional view of the present invention (in which the nails are shown in the retracted condition).
Figure 3:
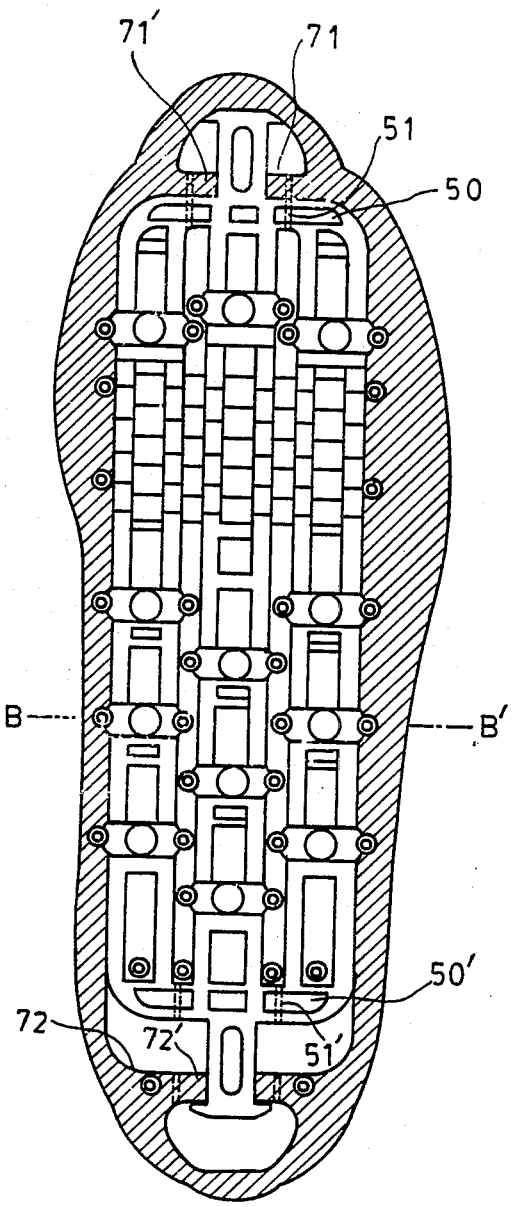
FIG. 3 is a cross sectional view of FIG. 1 taken along line AA'.
Figure 8:
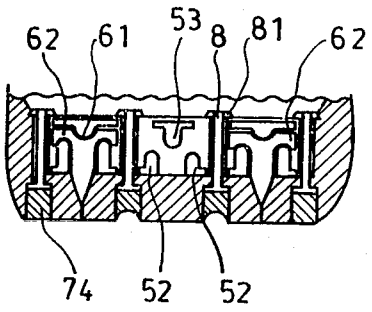
FIG. 8 is a sectional view of FIG. 3 taken along line BB' (showing the nails retracted in the sole).

Referring to FIGS. 1 and 3, the shoe according to the present invention comprises a front cover 1; a rear cover 2, an upper pad plate 3, a lower pad plate 4, a driving member 5, driven nails or spikes 6, sole 7 and bosses 8 (FIG. 8). The front and rear covers 1 and 2 are sealed parts having considerable elasticity to restore to the normal shape after being kicked. The driving member 5 is provided with front and rear vents 51 (FIG. 3) and 51'.

The front and rear brake members 71 and 72 of the sole 7 are respectively formed with vents 71' which are in communication with the vents 51 and 51' so as to maintain the pressure in the front and rear covers equal to that of the external air, and to prevent the front tip and the heel portion of the shoe from having a recess or being indented upon being kicked forwards or kicked backwards. The aforesaid vents can provide the front tip and heel portion with a buffer effect when being hit unintentionally.

The upper pad plate 3 and the lower pad plate 4 are respectively thin and rigid plates of suitable elasticity. The inside surface of each plate is a smooth surface so as to facilitate movement of the driving member 5. The upper sole and the lower sole have a non-smooth surface so as to provide friction between the soft foot pad and the pad plate, and between the lower sole and the pad plate for enchanced sealing and the aforesaid elements. The narrow portions of the upper and lower pad plates (as shown in FIG. 1), have thicker foot pads, respectively. A plurality of chain links 54 are mounted in the central portion of the sole. The sole under the chain links 54 is furnished with several lateral grooves (both ends of those grooves are sealed and closed to the outside of the sole). The narrow portion of the pad plate is exactly under the joint portion between the metatarsus 91 and the phalanx 92 of the foot, which can provide a rigid effect upon the shoe being kicked forwards or backwards. When walking, that portion will provide the sole with a considerable softness so as to facilitate the movement of the bone joint (bent or stretched); in other words, that structure is in compliance with the requirement of human engineering.

Figure 6:
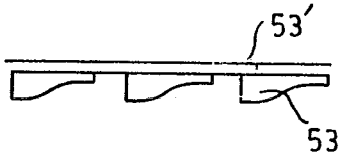
FIG. 6 is a side view of the T-shaped sliding rail of the present invention.
Figure 7:
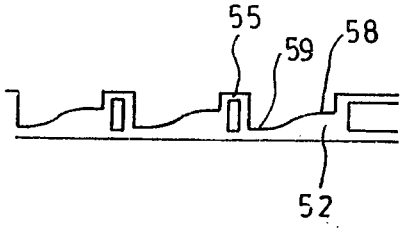
FIG. 7 is a side view of the inverted T-shaped sliding rail in the driving member of the present invention.

The driving member 5 includes a dual sliding rail structure or inverted T-shaped sliding rail and the single sliding rail 53 (FIG. 6-hereinafter referred to as T-shaped sliding rail) and which are formed to extend at an inter-complementary angle between their contact surfaces so as to increase the stability, reliability and rigidity of the driving member 5 and the linking parts 55 (FIG. 7) mounted near, either in front of or behind, the driven nails 6.

Further, both the driving member 5 and the nails 6 are finished to provide smooth surfaces and can include a lubricating coating such as fatty acid. The contact between the sliding rails 52 and 53 and the nails 6 is by means of a point or line method, i.e., the contact surfaces are all curved surfaces. Therefore, upon the driving member 5 being moved in or moved back, the nail 6 can only be raised or pressed down without deviating from the desired direction or causing any resistance thereby to preclude problems with the shoe.

The sole 7 of the present invention may be of a material having a high elasticity, such as rubber or the like. The shape of the nail hole 73 is similar to that of the driven nail 6, but the diameter of the nail hole 73 is smaller than that of the driven nail 6 so that the latter is tightly held. Prior to inserting the driven nail 6, each of the nail holes 73 is filled with molten wax so as to facilitate the nail 6 to slide up and down, and to prevent a self-sealing effect to prevent water and dust from entering therein.

Figure 4:
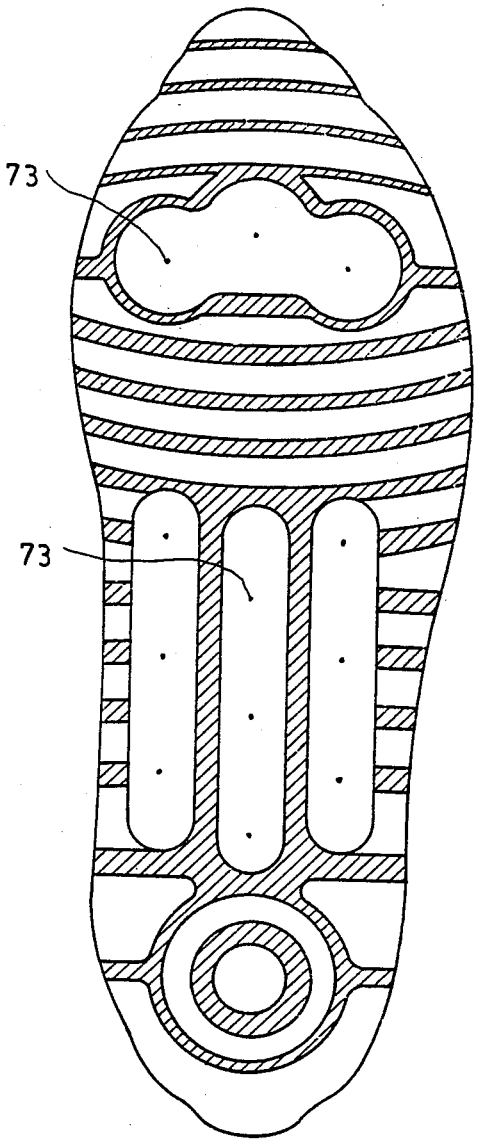
FIG. 4 illustrates the relative positions of the nail holes disposed in the sole pattern according to the present invention.

The nail holes 73 are all arranged to be at the projected pattern portion on the outsole of the shoes so as to increase its water-proof character upon the sole touching the ground (see FIG. 4). The circular-shaped sole patterns can provide the best elasticity and wear-and-tear durability because of the patterns being able to resist impacts and movements from all directions so as to preclude cracking and slipping. In accordance with the natural curvature of a human's feet (as shown in FIG. 1), the present invention is such that the sole portion under the curvature portion of the human's feet would have less pressure applied in the swing phases during walking (i.e., the pressure is evenly distributed), and so that the sole portion under the curvature portion of the human's feet will suffer from less impact and wear-and-tear; therefore, the nails have less wear-and-tear, provide the feet with a grip force and direction-changing effect, and reduce the impact effect between the nails and the ground surface to protect the feet. The position of the nails mounted in the sole is such that the serviceable life of the shoes will be considerably increased.

Figure 9:
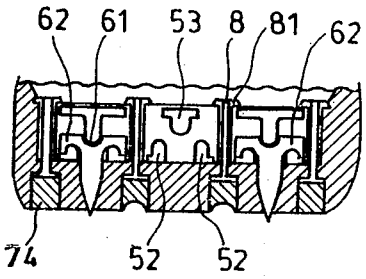
FIG. 9 is a sectional view of FIG. 3 taken along line BB' (showing the nails extended out of the sole).

By means of the bosses 8 and the sleeves 81, the upper pad plate 3 and the lower pad plate 4 can be maintained at a constant distance therebetween. Upon the driving member 5 being kicked forwards or backwards, the pad plates are not deformed to hinder the operation of the driving member 5; further, the sole 7 can also be tightly locked on the lower pad plate 4 by means of the bosses 8 and sleeves 81, and the nails 6 can easily be driven out of the sole without causing the sole to project outwards. After the bosses 8 are locked in position, the boss holes 74 (as shown in FIGS. 8 and 9) are sealed with an adhesive. The head portion of each of the bosses 8 is slightly projecting above the surface of the upper pad plate 3 so as to prevent the pad plate from becoming slippery and loose, and also to prevent the whole structure of the shoe to give a loose and swinging feel.

Figure 2:
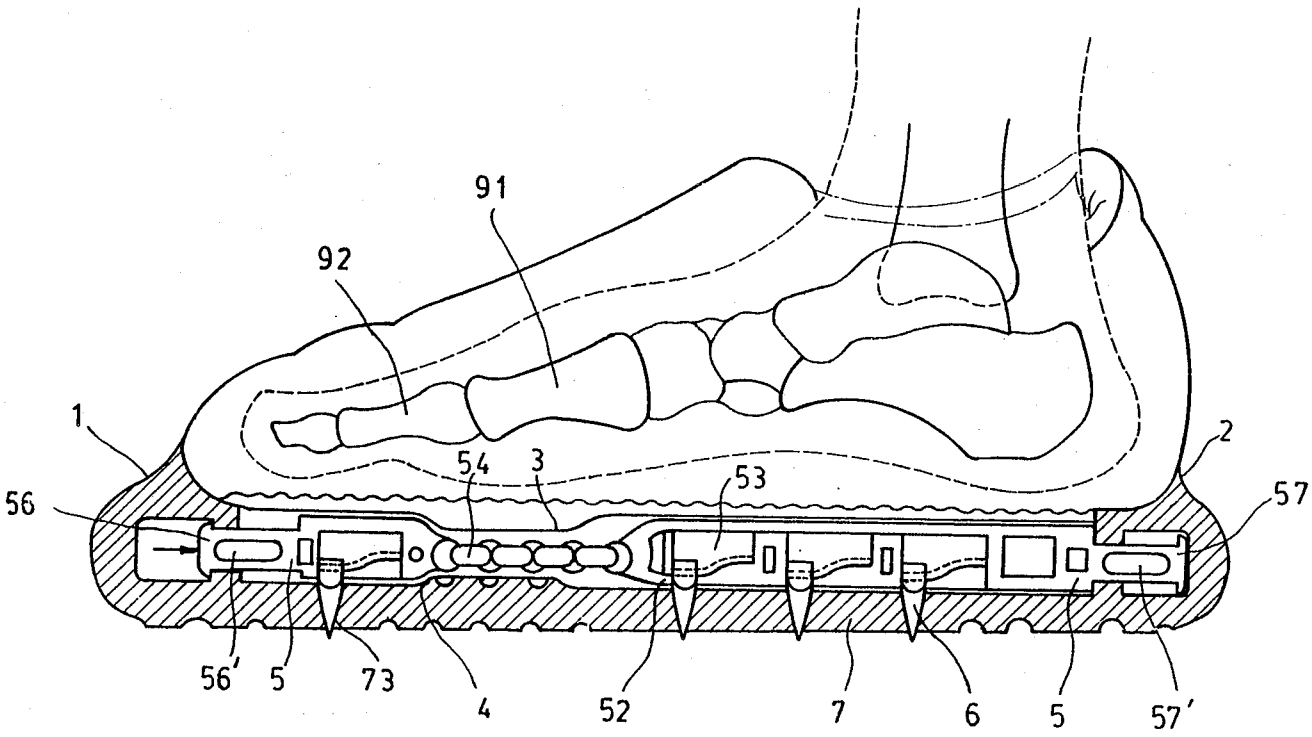
FIG. 2 illustrates another longitudinal sectional view of the present invention (in which the nails are shown in extended condition).
Figure 5:
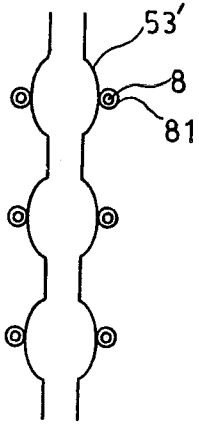
FIG. 5 is a top view of the contact surface between the T-shaped sliding rail in the driving member and the upper pad plate.

The features of the present invention with respect to weight, stress or elasticity are described as follows:

a. Both the front support 56' and the rear support 57' in the driving member are provided with a hollow tube portion as shown in FIGS. 1, 2, and 3.

b. The contact portion between the upper portion of the T-shaped sliding rail 53 and the upper pad plate 3 is at the widest portion thereof, which is also the highest protected portion thereof (as shown in FIG. 5).

c. The portion other than the upper pad plate 3, the lower pad plate 4, and the driving member 5 is furnished with an elongated hollow portion (including the nail hole) so as to provide elasticity to the shoes for allowing necessary flexing or bending.

d. The screen or lattice-shaped front and the rear shoulder portions 50 and 50' are respectively furnished with three hollow spaces (as shown in FIG. 3).

e. The nails 6 are subjected to hardening and surface finish treatments (such as being coated with chromium).

The operation of a shoe according to the present invention is as follows:

To preclude from slipping on a surface, or when requiring to start a motion or to brake a motion (such as pushing or pulling a heavy article, by applying a physical force thereto), the wearer of the present invention may kick the front ends of the shoes against a rigid article (such as a wall or road surface) to cause the driving member 5 to move backwards until the front top member 56 has moved a given distance and is stopped by the front brake member 71 (i.e. until most of the impact force has been absorbed by the T-shaped sliding rail 53, to extend the nails 6, and by the rear brake member 72). The moving distance of the front top member 56 can be just such as to have the inverted T-shaped sliding rail 52 move from the highest portion 58 to the lowest portion 59 along the both shoulder portions 62 of each nail 6; simultaneously, the highest projecting portion of each of the T-shaped sliding rails 53 will slide and press into the grooves 61 on the top of the nails 6 to drive the nails 6 out of the sole, and maintained in a vertically pressing position. The nails 6 will be held firmly in position without loosening or being disengaged because of being gripped by the tight nail holes 73 and the shoulder portions of the inverted T-shaped sliding rail 52. Moreover, by means of the sleeves 81 of the bosses 8 and the fixing effect of the holes of the lower pad plate 4, the driving member 5 can not be deformed or move laterally to cause any resistance to the nails to move out for gripping the ground surface. In tree-climbing, the nails 6 will firmly and flexibly grip the tree, when a wearer of the shoes of the present invention wants to apply force to move forwards or backwards.

However, when a wearer of the present invention is walking on a surface without slippery possibility, the wearer may kick a stiff or hard article with the rear ends of the shoes to have the driving member 5 move forwards until the rear top member 57 is limited by the rear brake member 72 (i.e., most of the impact force has been absorbed by the inverted T-shaped sliding rail 52, to raise the nails 6, and by the front brake member 71). In that case, the inverted T-shaped sliding rail 52 is pushed from the lowest portion 59 to the highest portion 58 along the shoulder portions of the nails 6, being positioned in place; simultaneously, each of the T-shaped sliding rails 53 (i.e., the projected members pressed on the nails) will be moved forwards so as to have the nails 6 pushed upwards smoothly by the inverted T-shaped sliding rail 52, to let all the nails 6 retract into the sole. Since the upper and the lower pad plates 3 and 4 are separated with a given space by means of the bosses 8 and sleeves 81, the nails 6 would not be pressed out of the soles during normally walking; in other words, the nails 6 can be driven out or retracted in only when the shoes are being kicked forwards or backwards; otherwise, the nails 6 will be maintained in a normal or retracted condition.

Upon kicking forwards or backwards the shoes according to the present invention will restore their normal and straight shape; further, any sand or water attached to the soles can be removed by kicking or shaking so as to let the nails extend out clearly and to have the nail holes closed completely upon the nails being retracted again.

In comparison with the conventional shoes, the present invention has the advantages as follows:

a. Since the soles and the sandwiched members are adequately reinforced, both the feet and shoes are provided a better protection.

b. The shoes according to the present invention have the function of the conventional nail-shoes without damaging a road surface, and they also can used as an oridinary shoes to walk on a slippery ground surface without slipping.

c. A pair of shoes can be used for purposes, i.e., they can be used as nail shoes without really changing shoes or bringing a pair of nail shoes, which might damage the slipping-proof surface; a person who wears the shoes according to the present invention can safely walk on any surface. The shoes of the present invention are deemed an economic type of shoes.

d. Since the sealed portion of the sole has a considerable height, the wearer can maintain his (or her) feet dry and the shoe vamp clean upon walking on a wet or muddy road.

e. The present invention has provided the wearer with a biological vital force such as a claw and palm, whereby the wearer can climb a tree, a cliff, or walk on single-lumber bridge, a slippery ground, a rocking and slippery deck, and a field under windy and rainy weather.

f. The wearer of the present invention would have more working efficiency during pushing a car, an object, or braking over a slippery slope, or handling articles at a working site.

g. The present invention is in conformity with the human engineering theory so as to protect the feet in a healthy condition.

h. The shoes according to the present invention can also used as rain shoes, ice shoes, boots, fire-fighting shoes, seaman shoes, worker's shoes, leisure-time shoes, mountaineer's shoes, student shoes, military and police shoes, golf shoes, new fashion shoes and surf-fishing shoes, etc.

The aforesaid embodiment is used for describing the objects, the features and the functions; any change or modification of the present invention made by any person skilled in the art should not be deemed having deviated from the spirit or scope of this invention. The scope of the present invention is defined with the claims attached hereto.

I claim:

1. A shoe for traversing various surfaces, said shoe comprising, in combination:

a sole, said sole having a top and a bottom defining a front edge, a central portion, and a rear edge, said sole having a brake formation near said front edge, a hollow formation in said central portion, a brake formation near said rear edge, a narrowed part generally located between the metatarsus and the phalanx of the foot of a respective user of said shoe, and lateral grooves at said bottom of the sole, said bottom of said sole further including a plurality of nail holes with a diameter slightly less than the diameter of respective driven nails;

a front cover, said front cover including a flexible member sealingly secured at the front edge of said sole, and including vent formations which are in communication with said central portion;

a rear cover, said rear cover including a flexible member sealingly secured at the rear edge of said sole, and including vent formations which are in communication with said central portion;

an upper pad plate arranged above a respective driving member and connected to said sole at the top thereof;

a lower pad plate arranged under a respective driving member and connected to said sole at the bottom thereof;

a driving member, said driving member including a front top member, a dual sliding rail, a single sliding rail, a chain link assembly and a rear top member, said driving member being sandwiched between said upper pad and said lower pad plate;

a plurality of driven nails, each of which has a sharp lower point and a central groove formation at the top thereof for engagement with a respective element of said driving member;

said driving member being able to move backwards upon said front cover being kicked, whereby said single sliding rail forces said driven nails to extend downwardly; and said driving member being able to move forward upon said rear cover being kicked so as to cause said driven nails to be retracted into said sole.

2. A shoe as claimed in claim 1, wherein said front top member has at least one projecting part, and said front top member is mounted within said front cover, but before said front brake formation; and said driving member further comprising:

a plurality of dual sliding rails, each of which each has at least two projecting parts with the upper portion thereof being a curved part, and said dual sliding rails being mounted in an lower portion of said sole;

a plurality of single sliding rails, each of which has a single projecting part with a point portion in the form of a small curve, said single sliding rails being mounted within an upper portion of said sole but arranged in parallel with said dual sliding rails along mutually complimentary contact surfaces; and said driven nails being operatively connected to said two types of sliding rails;

a plurality of linking parts, of which each has a high portion and a low portion for pushing said driven nails to extend out and for retracting said driven nails back;

a chain link mounted in the narrow portion inside said sole and being positioned between said metatarsus and said phalanx when said shoe is put on a foot; and said rear top member being similar in shape to the shape of said front top member, being mounted inside said rear cover, and behind said rear brake member;

the aforesaid assembly being characterized in that when said driving member is moved backwards through the related functions of said single sliding rail and said linking parts, said driven nails being driven to extend out of the sole bottom surface, and when said driving member is moved forward, said nails being retracted back into said sole; and said sole having sufficient capacity to bend by means of said chain link without affecting the force transmission of said driving member.

3. The shoe as claimed in claim 1, wherein said pad plates are made of a thin metal material with the inner surface of each pad plate being a smooth surface and the outer surface of each pad plate being non-smooth.

4. The shoe as claimed in claim 1, wherein said pad plates are made of a thin non-metal material with the inner surface of each pad plate being a smooth surface and the outer surface of each pad plate being non-smooth.

5. The shoe as claimed in claim 1, wherein said sole is made of a highly elastic material such as rubber and the like and has a groove pattern at its bottom surface; and wherein said nails extend out of said sole within recessed portions of said groove pattern on the sole bottom surface; and each nail hole being similar to the base portion of a respective nail, with the diameter of each nail hole being less than that of a respective nail so as to have a respective hole tightly held around a respective nail; and prior to insertion of nails into said nail holes, each one of said nail holes being filled with wax so as to have said nails slide up and down smoothly, and said wax also providing said holes with water-tightness and dust-tightness.

6. The shoe as claimed in claim 1, wherein bosses and sleeves are used for reinforcement between said upper and lower pad plates and said sole so as to maintain a given distance between said upper pad plate and said lower pad plate, and also to facilitate said nails to extend out or to be retracted in smoothly.

7. The shoe as claimed in claim 1, wherein each of said nails has a flat upper surface and curved lower surfaces, said curved surfaces operatively contacting at least said dual sliding rail, and each nail having a front edge adapted to contact said single sliding rail for extending said nail as aforesaid.

8. The shoe as claimed in claim 1, wherein at least some elements of said driving member are finished with a smooth surface such as obtained by electroplating and then being coated with a thin lubricant such as a fatty acid for water and rust proofing purposes.

9. The shoe as claimed in claim 1, wherein said front and rear top members are hollow; wherein the contact between the top of said single sliding rail and said upper pad plate is such that the respectively widest portion is the respectively most downwardly projecting portion thereof; wherein the portions other than the contact portion between said upper and lower pad plates and said driving member are substantially O-shaped hollow portions, including said nail holes, so as to facilitate the shoe to bend freely during walking; and wherein respective shoulder portions are arranged to provide a hollow core having at least three sections.

* * * * *